US005894523A

United States Patent [19]

Freeman

[11] Patent Number: 5,894,523

[45] Date of Patent: Apr. 13, 1999

[54] VOICE DELAY FEEDBACK APPARATUS

[76] Inventor: Michael J. Freeman, 1270 Avenue of the Americas, Suite 2401, New York, N.Y. 10020

[21] Appl. No.: 08/859,618

[22] Filed: May 20, 1997

[51] Int. Cl.[6] ..... H04R 3/00

[52] U.S. Cl. ..... 381/95

[58] Field of Search ..... 381/95, 68, 312, 381/74; 455/41; 704/272, 270

[56] References Cited

U.S. PATENT DOCUMENTS

| | | | |
|---|---|---|---|
| 3,659,056 | 4/1972 | Morrison et al. | 455/41 |
| 4,471,171 | 9/1984 | Kopke et al. | 381/68 |
| 5,418,778 | 5/1995 | Cummiskey | 379/406 |

*Primary Examiner*—Vivian Chang
*Attorney, Agent, or Firm*—David M. Klein; Shearman & Sterling

[57] ABSTRACT

An audio delay and feedback apparatus includes i) a microphone for receiving an input audio signal and for generating a first electrical signal corresponding to the input audio signal, ii) a delay circuit for receiving the first electrical signal and for generating a second electrical signal corresponding to but delayed from the first electrical signal by a predetermined amount of time, and iii) earphones or a speaker for receiving the second audio signal and for generating an audio output signal corresponding thereto. An audio signal input to the microphone is delayed and fed back to the earphones so as to make speech difficult, humorous, discombobulated, and often unintelligible. The microphone, earphones and delay circuit are mounted on a headset. In one embodiment, the first electrical signal is digital and the delay circuit includes a digital memory. An A/D converter digitizes the first electrical signal and a D/A converter converts the second electrical signal to an analog signal. The system includes a memory for storing the first electrical signal and a playback circuit for selectively playing back the memory to the earphones. The playback circuit is controlled by a manually actuated switch on the headset. In an alternative embodiment, the delay circuit includes i) a moving continuous magnetic tape, ii) a write head for writing the first electrical signal onto the magnetic tape, and iii) a read head spaced from the write head for reading the first electrical signal from the tape, the read head generating the second electrical signal.

14 Claims, 2 Drawing Sheets

VOICE DELAY FEEDBACK APPARATUS

BACKGROUND OF THE INVENTION

1. Field of the Invention

The present invention relates generally to a novelty apparatus having a microphone and earphones, and in which an audio signal input to the microphone is delayed and fed back to the earphones so as to make speech difficult, humorous, discombobulated, and often unintelligible.

2. Description of the Related Art

Audio feedback loops are well known in the audio field. Generally speaking, a feedback loop is an undesired consequence of having an amplified audio signal fed back through the amplification loop. In an audio system, a microphone is used to receive an audio input signal, which is then amplified by an audio amplifier and output through a speaker. The feedback loop is created when the output signal from the speaker is subsequently received by the microphone. The feedback can cause undesired consequences, typically a high-pitched squeal sound, when the input signal and the amplified signal are out of synch with each other, or distortion. In general, audio feedback is an undesired side effect in audio systems.

On the other hand, in order to speak properly humans typically require audio feedback between what they say and how they hear what they say. In other words, in order to speak properly the person speaking must hear what he or she is saying. In the absence of such feedback (such as when a person is deaf), speech becomes difficult. If a device can change such feedback, then it can interfere with normal speech. Such a system could be used as a novelty device in order to observe the reaction of the user's speech to the feedback. Such person speaks as if they were drunk or a stutterer.

SUMMARY OF THE INVENTION

The present invention is an audio delay and feedback apparatus which includes i) audio input means for receiving an input audio signal and for generating a first electrical signal corresponding to the input audio signal, ii) delay means for receiving the first electrical signal and for generating a second electrical signal corresponding to but delayed from the first electrical signal by a predetermined amount of time, and iii) audio output means for receiving the second audio signal and for generating an audio output signal corresponding thereto.

The audio input means is preferably a microphone and the audio output means is preferably earphones, with the microphone and earphones are mounted on a headset. The delay means is preferably also mounted on the headset, making the unit self-contained.

In a preferred embodiment, the first electrical signal is digital and the delay means comprises a digital memory. An A/D converter digitizes the first electrical signal and a D/A converter converts the second electrical signal to an analog signal. The system includes a memory for storing the first electrical signal and playback means for selectively playing back the memory to the audio output means. This enables the user to playback a previously recorded segment to enable the user to hear how he/she sounded while speaking and simultaneously receiving delayed feedback. The playback means is preferably a manually actuated switch on the headset.

In an alternative embodiment, the delay means includes i) a moving continuous magnetic tape, ii) a write head for writing the first electrical signal onto the magnetic tape, and iii) a read head spaced from the write head for reading the first electrical signal from the tape, the read head generating the second electrical signal.

DETAILED DESCRIPTION OF THE INVENTION

Figure 1:
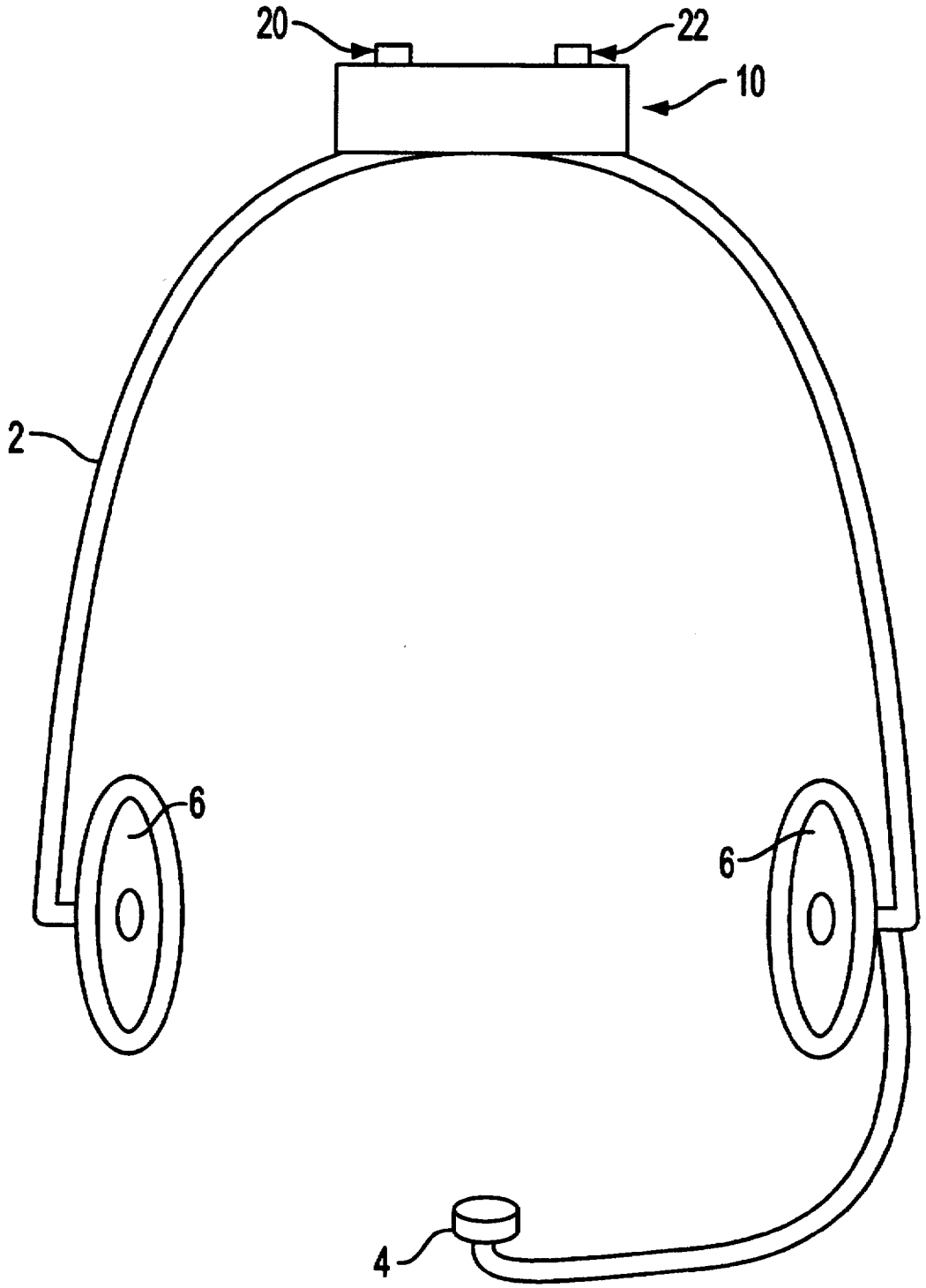
FIG. 1 is a schematic diagram of the audio feedback system of the present invention.

As shown in FIG. 1, the present invention is a novelty audio feedback device that is generally self-contained in a headset 2. Headset 2 includes a microphone 4 positioned near the mouth of the user, and at least one, and preferably two, earphones 6. This type of headset is conventionally worn by telephone operators, singers and the like. Conventional wiring connects the microphone and earphones to a delay circuit 10.

The function of delay circuit 10 is to receive an audio input signal from microphone 4, to delay the audio signal by a predetermined amount of time, and to output the delayed audio signal to headset 2. In a preferred embodiment, the predetermined time delay is in the range of ½ second to 2 seconds. However, any appropriate time delay may be utilized as desired. Thus, in the system of the invention the sounds made by the person talking are delayed and played back to the ears through the earphones 6. This causes confusion to the speaker and renders the speaker unable to speak intelligibly. Typically, a user will not even be able to count to ten without repeating and/or skipping numbers. Saying simple nursery rhymes also becomes very difficult and the person comes across as being unintelligible, drunk, very humorous, as their speech is often incoherent.

Delay circuit 10 preferably includes batteries for powering the delay circuit, microphone 4 and earphones 6. Alternatively, delay circuit 10 may be powered by any appropriate A/C or D/C power source.

Figure 2:
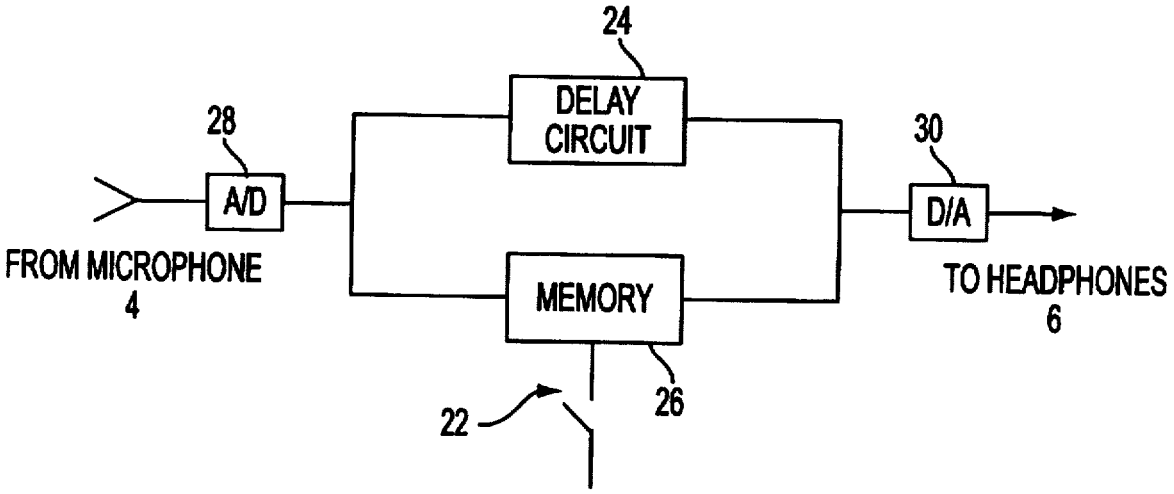
FIG. 2 is a schematic diagram of a digital embodiment of the delay circuit of the invention.

Delay circuit 10 may utilize any appropriate circuitry for introducing a time delay in an audio signal. In a preferred embodiment, as shown in FIG. 2, digital circuitry is used to implement the time delay. The input from microphone 4 is channeled through an analog-to-digital (A/D) converter 28 and input to a delay circuit 24. Delay circuit 24 is preferably a first-in/first-out memory that receives the digitized input signal and outputs the same digitized signal a predetermined time thereafter. The delayed digitized signal is then input to a digital-to-analog (D/A) converter 30 and output to headphones 6. A playback memory 26 is provided for storing the input from microphone 4 for a predetermined amount of time, preferably about 15 seconds. Memory 26 preferably records the sounds made by the user for later playback so that the user may hear how they sounded during use of the device. Delay circuit 10 preferably includes an on/off switch 20 and a playback switch 22. When playback switch 22 is actuated, the contents of memory 26, i.e., the previous 15 seconds of input from microphone 4, are output to headphones 6.

Figure 3:
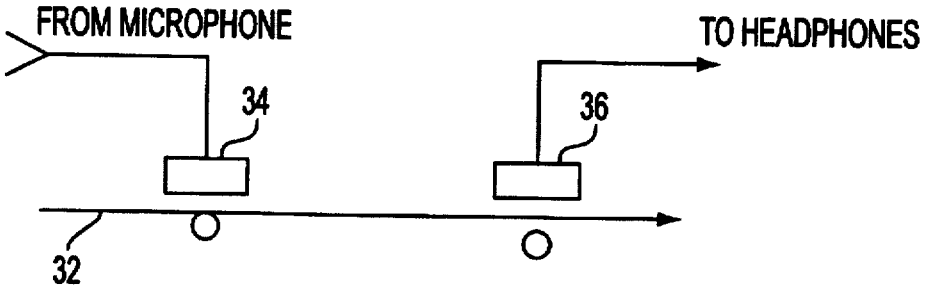
FIG. 3 is a schematic diagram of an audio tape embodiment of the delay circuit of the invention.

In an alternative embodiment, as shown in FIG. 3, a continuous loop of moving magnetic tape 32 may be utilized to delay the audio input from the microphone. The audio input from the microphone is input to a conventional record head 34 which records the analog audio signal onto moving magnetic tape 32. A predetermined time later, e.g., ½–2 seconds later, the recorded-upon portion of the magnetic tape passes read head 36 which reads the magnetic signal from moving tape 32 and outputs the signal to headphones 6.

It will be appreciated that any appropriate circuit for delaying the audio input signal, such as a fully analog circuit, fully integrated circuit or a microprocessor-based circuit, may be utilized as desired. Moreover, rather than being integrated within the headset, delay circuit 10 may be belt-worn, or a free-standing unit, e.g., a table-top mounted device. More generally, although the present invention has been described in detail with respect to certain embodiments and examples, variations exist that are within the scope of the invention as defined in the following claims.

What is claimed is:

1. A confusion-causing novelty apparatus for entertainment purposes which comprises:

a microphone for receiving a vocal input audio signal from a user and for generating a first electrical signal corresponding to the vocal input audio signal;

a digital delay circuit for receiving the first electrical signal and comprising circuitry for generating a second electrical signal corresponding to but predictably delayed from the first electrical signal; and earphones for receiving the second audio signal and for generating a vocal output audio signal audible to the user corresponding to the vocal input audio signal delayed by the digital delay circuit, the user hearing the vocal output audio signal from the earphones at least partially contemporaneously with generating the vocal input audio signal for intentionally confusing the speech of the user, wherein the vocal audio output signal does not echo the vocal input audio signal.

2. The confusion-causing apparatus in accordance with claim 1 wherein the microphone and earphones are mounted on a headset.

3. The confusion-causing apparatus in accordance with claim 2 wherein the digital delay circuit is mounted on the headset.

4. The confusion-causing apparatus in accordance with claim 1 wherein the first electrical signal is digital and wherein the digital delay circuit comprises a digital memory.

5. The confusion-causing apparatus in accordance with claim 4 further comprising an A/D converter for digitizing the first electrical signal.

6. The confusion-causing apparatus in accordance with claim 5 further comprising a D/A converter for converting the second electrical signal to an analog signal.

7. The confusion-causing apparatus in accordance with claim 1 further comprising a memory for storing the first electrical signal; and playback means for selectively playing back the memory to the earphones.

8. The confusion-causing apparatus in accordance with claim 7 wherein the playback means comprises a manually actuated switch.

9. The confusion-causing apparatus in accordance with claim 6 further comprising a digital memory for storing the first electrical signal; and playback means for selectively playing back the memory to the earphones.

10. The confusion-causing apparatus in accordance with claim 9 wherein the playback means comprises a manually actuated switch.

11. The confusion-causing apparatus in accordance with claim 3 further comprising power means mounted on the headset.

12. A confusion-causing novelty apparatus for entertainment purposes which comprises:

a microphone for receiving a vocal input audio signal from a user and for generating a first electrical signal corresponding to the vocal input audio signal;

a delay circuit for receiving the first electrical signal and comprising circuitry for generating a second electrical signal corresponding to but intentionally delayed from the first electrical signal by a predetermined amount of time, the delay circuit selected from the group consisting of a digital delay circuit, an analog delay circuit, an integrated circuit, and a microprocessor-based circuit; and earphones for receiving the second audio signal and for generating a vocal output audio signal audible to the user corresponding to the vocal input audio signal delayed by the delay circuit, the user hearing the vocal output audio signal from the earphones at least partially contemporaneously with generating the vocal input audio signal for intentionally confusing the speech of the user, wherein the vocal audio output signal does not echo the vocal input audio signal.

13. The confusion-causing apparatus in accordance with claim 12 wherein the delay circuit comprises i) a moving continuous magnetic tape, ii) a write head for writing the first electrical signal onto the magnetic tape, and iii) a read head spaced from the write head for reading the first electrical signal from the tape, the read head generating the second electrical signal.

14. A confusion-causing novelty apparatus for entertainment purposes which comprises:

a microphone for receiving a vocal input audio signal from a user and for generating a first electrical signal corresponding to the vocal input audio signal;

a delay circuit for receiving the first electrical signal and comprising circuitry for generating a second electrical signal corresponding to but intentionally randomly delayed from the first electrical signal by a predetermined amount of time, the delay circuit not delaying the first electrical signal by an impedance mismatch; and earphones for receiving the second audio signal and for generating a vocal output audio signal audible to the user corresponding to the vocal input audio signal delayed by the delay circuit, the user hearing the vocal output audio signal from the earphones at least partially contemporaneously with generating the vocal input audio signal for intentionally confusing the speech of the user, wherein the vocal audio output signal does not echo the vocal input audio signal.

* * * * *